US007134832B2

(12) United States Patent
Schrepferman et al.

(10) Patent No.: US 7,134,832 B2
(45) Date of Patent: Nov. 14, 2006

(54) METHOD AND APPARATUS FOR MOUNTING A FRONT LOADER TO A TRACTOR

(75) Inventors: John J. Schrepferman, South Elgin, IL (US); Gale A. Holloway, New Lenox, IL (US)

(73) Assignee: CNH America LLC, New Holland, PA (US)

( * ) Notice: Subject to any disclaimer, the term of this patent is extended or adjusted under 35 U.S.C. 154(b) by 10 days.

(21) Appl. No.: 10/929,018

(22) Filed: Aug. 27, 2004

(65) Prior Publication Data

US 2006/0045712 A1 Mar. 2, 2006

(51) Int. Cl.
*E02F 3/34* (2006.01)

(52) U.S. Cl. ..... 414/686; 172/275

(58) Field of Classification Search ..... 414/686; 172/272–275; 29/700
See application file for complete search history.

(56) References Cited

U.S. PATENT DOCUMENTS

| | | | | |
|---|---|---|---|---|
| 4,379,673 | A * | 4/1983 | Takahashi et al. | 414/686 |
| 4,498,839 | A | 2/1985 | Williams et al. | 414/686 |
| 4,548,543 | A | 10/1985 | Lenertz et al. | 414/686 |
| 4,798,511 | A | 1/1989 | Kaczmarczyk et al. | 414/686 |
| 4,968,213 | A | 11/1990 | Langenfeld et al. | 414/686 |
| 5,232,330 | A | 8/1993 | Rae et al. | 414/686 |
| 5,540,289 | A | 7/1996 | Hirooka et al. | 172/274 |
| 5,620,297 | A | 4/1997 | Mahaney | 414/686 |
| 5,895,199 | A | 4/1999 | Baumert, III et al. | 414/686 |
| 6,386,821 | B1 | 5/2002 | Schneider | 414/686 |
| 6,530,741 | B1 | 3/2003 | Kourogi et al. | 414/686 |
| 2003/0099534 | A1 | 5/2003 | Yoshii et al. | 414/686 |

* cited by examiner

*Primary Examiner*—Donald W Underwood
(74) *Attorney, Agent, or Firm*—Stephen A. Bucchianeri; John William Stader; Michael G. Harms

(57) ABSTRACT

Method and apparatus to simplify the process of adding a loader to a tractor after the manufacturing process. A pair of mounting brackets, one on each side of the tractor, each comprises a front piece and a rear piece. The rear piece is affixed to the tractor during the manufacturing process and the front piece, including a bearing surface for a transverse support axis of a loader, is selectively affixed to the respective rear piece and tractor when a decision to incorporate a loader is taken.

5 Claims, 3 Drawing Sheets

METHOD AND APPARATUS FOR MOUNTING A FRONT LOADER TO A TRACTOR

BACKGROUND OF THE INVENTION

The present invention relates generally to tractors and front loaders, and more particularly to a bracket for attaching a front loader to a tractor.

It is common practice for tractors to include loaders to which a large variety of attachments can be connected to provide a wide range of applications in the agricultural, industrial and construction fields. Such loaders are usually mounted on the front end of a tractor and generally include a bracket, acting as the interface between the tractor and the loader, a loader frame assembly, boom arms pivotally mounted to the frame, an attachment mounted across the forward ends of the boom arms, tilt cylinders coupled between the attachment and the boom arms, and a lift cylinder or cylinders coupled between the frame assembly and the boom arms. An exemplary structure of this general type loader/tractor/bracket is shown in U.S. Pat. No. 5,895,199 to Baumert, III et al.

The normal commercial practice for providing a tractor with a loader to an end customer is to build the tractor and ship it to a local dealer where the bracket and loader are then affixed to the tractor prior to delivery. Alternatively, in the case of a later decision, this process may occur in the field after purchase and use of the tractor by the customer. The problems associated with dealer installation of the loader are significant in the practical world. For instance, dealer installation in most cases requires extensive removal of tractor components to complete, and thus takes considerable time. Time is money. Additionally, dealer installation requires clamping/friction loads on the joint between the front and rear pieces. It is preferable that the loading on the bolts be in tension and compression. Dealer installation also requires periodic hardware torque checks to maintain integrity.

It would be of significant advantage to develop a simple, yet reliable mounting bracket that reduces or eliminates the above-described problems and difficulties.

SUMMARY OF THE INVENTION

Accordingly, it is an important object of the present invention is to provide a method to reduce the complexity, time required and cost of adding a loader to a tractor after its manufacture.

It is another object of the present invention to provide a method to simplify the process of adding a loader to a tractor after or at the time of sale of the tractor to an end customer.

It is another object of the present invention to provide a two-piece loader bracket for greatly reducing the complexity, labor and cost of adding a loader to a tractor after the tractor has been manufactured.

It is another object of the present invention to provide a two-piece bracket for mounting a loader to a tractor, each piece having a generally vertical planar surface with bolt holes therethrough in matching patterns to permit a rigid connection between the pieces.

It is a still further object of the present invention to provide a loader bracket comprised of a front piece and a rear piece. The rear piece is rigidly affixed to the tractor during the manufacturing process and the front piece is selectively added later when it is determined to incorporate a loader.

It is another object of the present invention to provide a two-piece bracket for mounting a loader to a tractor, each piece having a generally vertical planar surface with bolt holes therethrough in matching patterns to permit a rigid connection between the pieces.

It is another object of the present invention to provide a mounting bracket for a loader that is durable in construction, inexpensive to manufacture, carefree of maintenance, facile in assemblage, and simple, versatile and effective in use.

These and other objects are achieved by providing method and apparatus to simplify the process of adding a loader to a tractor after the manufacturing process. A pair of mounting brackets, one on each side of the tractor, each comprise a front piece and a rear piece. The rear piece is affixed to the tractor during the manufacturing process and the front piece, including a bearing surface for a transverse support axis of a loader, is selectively affixed to the respective rear piece and tractor when a decision to incorporate a loader is taken.

DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "left" or "right" are used as a matter of mere convenience, and are determined by standing at the rear of the machine facing in its normal direction of travel. Furthermore, the various components shown or described herein for any specific application of this invention can be varied or altered as anticipated by this invention and the practice of a specific application of any element may already by widely known or used in the art by persons skilled in the art and each will likewise not therefore be discussed in significant detail.

Figure 1:
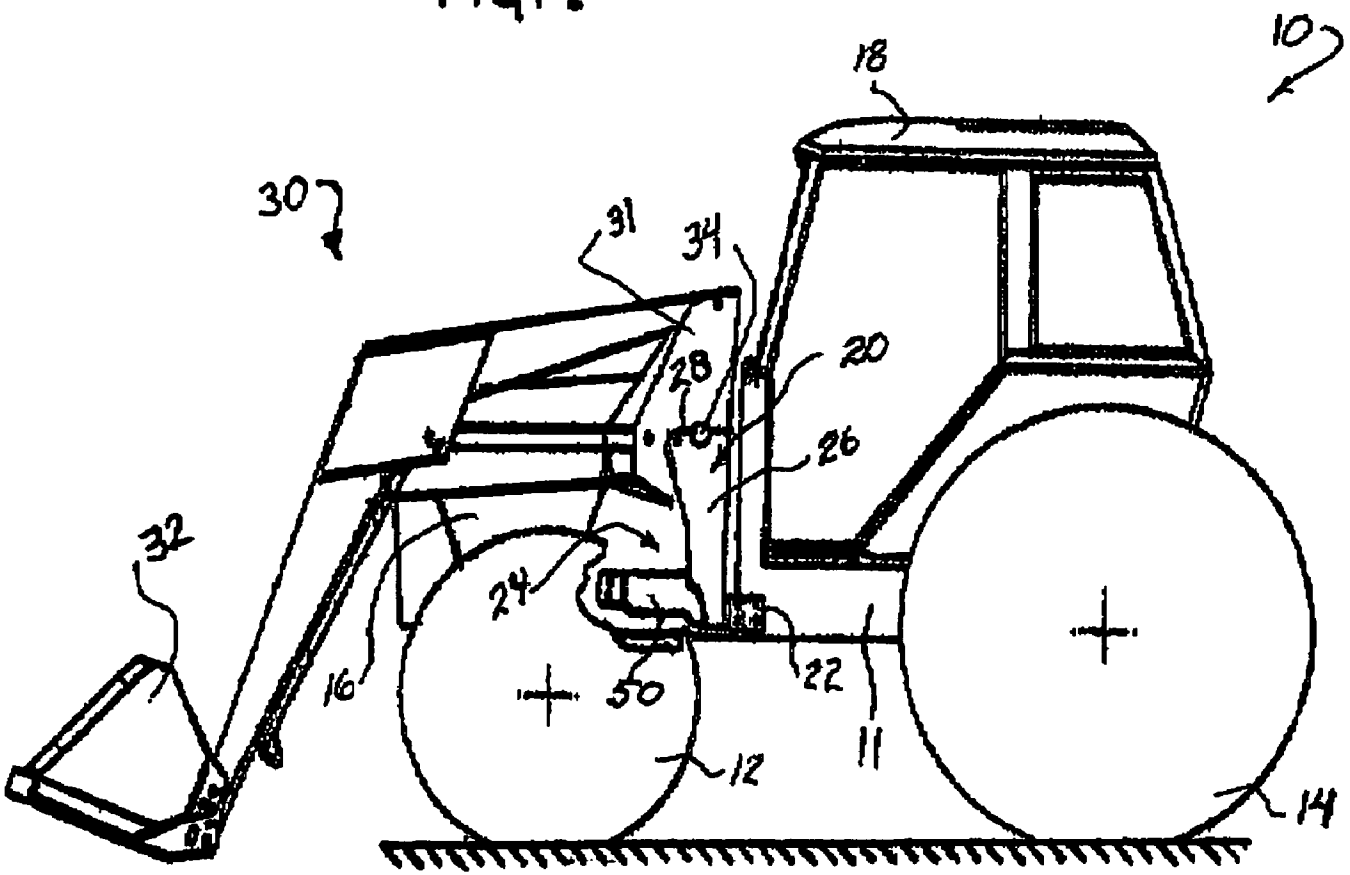
FIG. 1 is a partial left side elevational view of a tractor with a break-away showing the mounting bracket of the instant invention with a cut-out portion showing the construction of the front piece.

FIG. 1 shows an exemplary tractor to which the instant invention may be incorporated. Generally, tractor 10 has a longitudinal axis (not shown) extending through the tractor in a direction corresponding to a line defined generally by the direction of movement of the tractor. A generally longitudinal main frame 11 supported by wheel pairs 12, 14 may be incorporated as a primary structural element of tractor 10 and to which many of the tractor components are attached. Alternatively, the rear axle and transmission assembly could fill the need for structural strength, and as the support for other tractor components, such as an engine 16 and cab 18. Of course, one of skill in the art will understand that other structural arrangements are possible and in use.

For purposes of clarity, it should be appreciated that the bracket of the instant invention will be described and shown as a left-hand bracket. In most cases, two brackets will be required, one on each side of the tractor, to support an axis for the loader. The left and right-hand brackets, particularly the front pieces thereof, while similar are in reality mirror images of each other.

Referring still to FIG. 1, mounting bracket 20 comprises a rear piece 22 and a front piece 24. Front piece 24 has a generally vertical member 26 with a semi-circular upward-opening bearing surface 28 holding a bushing 29 (best seen in FIG. 2). Exemplary loader 30 has a plurality of linkages (most not numbered) terminating forwardly with bucket 32 and rearwardly with attachment assembly 31. Attachment assembly 31 may be a single structure or two interconnected structures, one adjacent each side of the tractor 10. From each side of attachment assembly 31 a transverse axis or pin 34 extends outwardly to engage respective bearing surfaces 28. Thus, the axle or pins 34 support the rear of loader 30. Attachment assembly 31 is also bolted to front piece 22, as at stop block 58.

Figure 2:
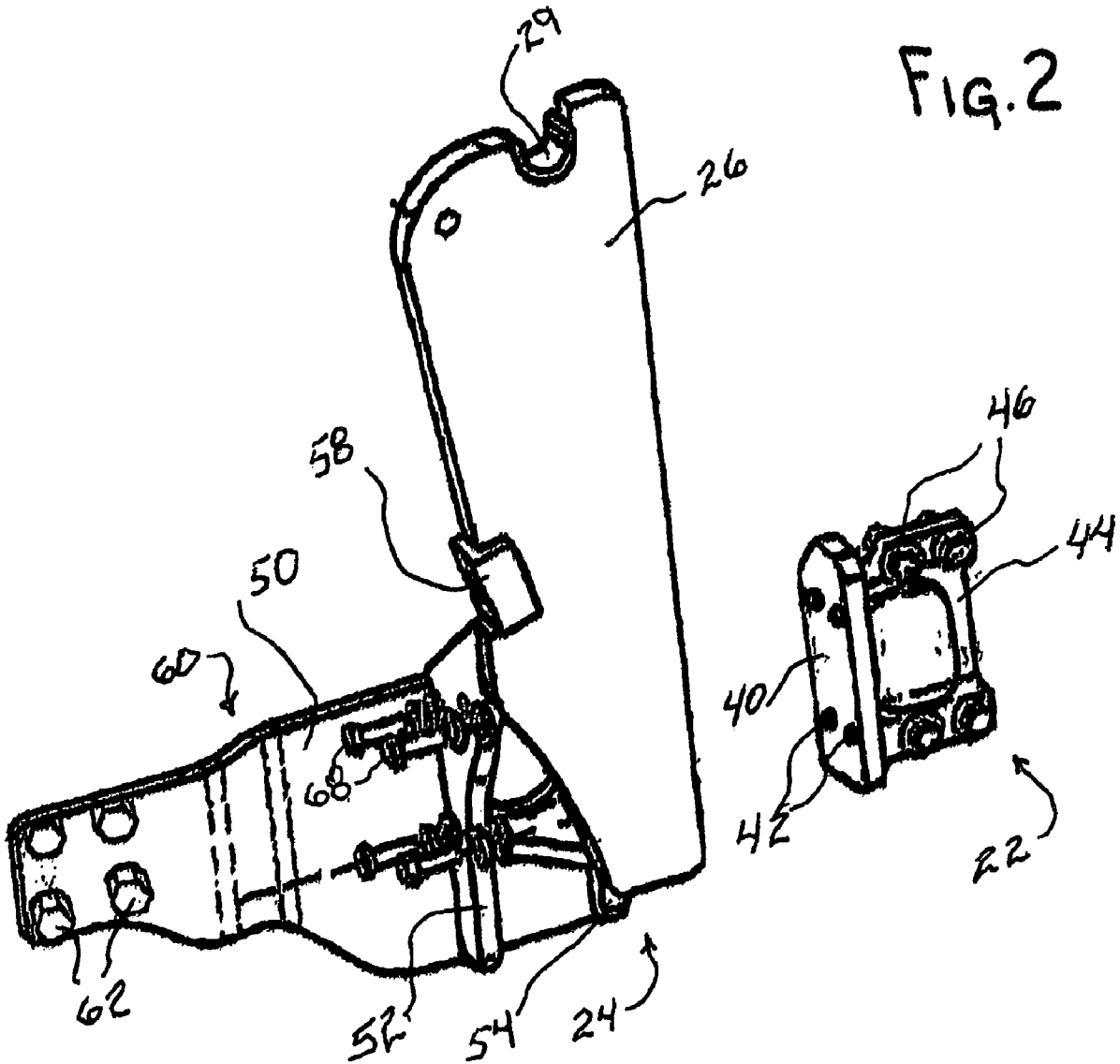
FIG. 2 is a perspective exploded view of a right side bracket of the instant invention.

FIG. 2 provides a perspective representation of the rear and front pieces 22, 24. Rear piece 22 includes a generally vertical planar surface 40, generally perpendicular to the longitudinal axis of tractor 10, with a plurality of bolt holes 42 therethrough; holes 42 arranged in a symmetrical pattern of two rows of two holes each. Other patterns could be used without straying from the concepts of the instant invention. Rear piece 22 further includes a rearwardly extending flange 44, also with bolt holes therethrough; flange 44 being generally perpendicular to surface 40. The bolt holes through flange 44 are arranged in a second pattern that matches a pattern of holes on a structural member of tractor 10, such as, for example, the transmission or rear axle housing (neither shown) to rigidly affix rear piece 22 by bolts 46 to the tractor. In practice, rear piece 22 may be the same for the left and right sides or they may be slightly different depending upon other tractor components that may interfere with the attachment of the rear piece to a structural member of the tractor.

Figure 4:
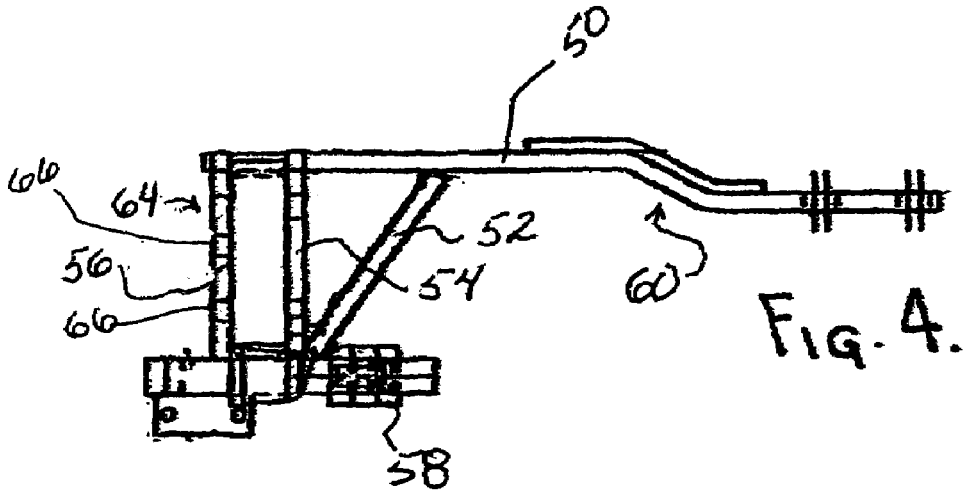
FIG. 4 is a top plan view of the front piece of FIG. 2.
Figure 3:
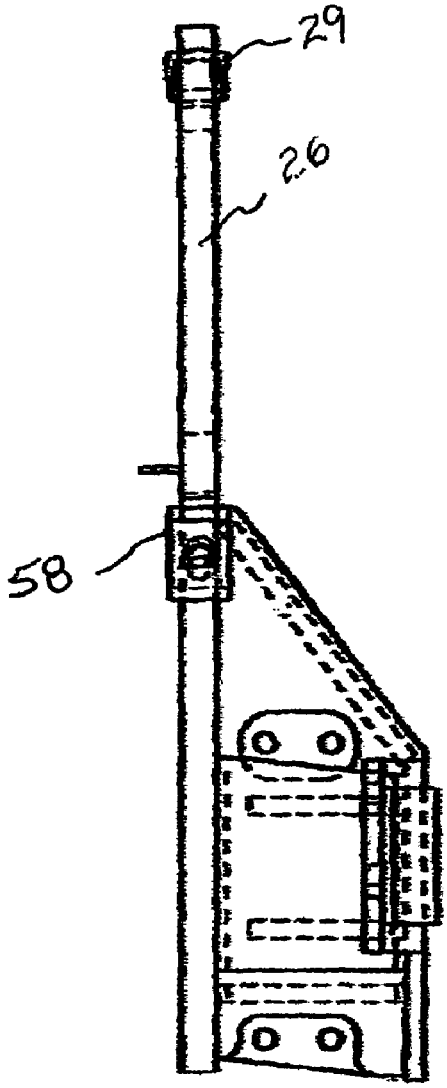
FIG. 3 is a front plan view of the front piece of FIG. 2.

Referring to FIGS. 2–4, front piece 24 is comprised primarily of generally vertical member 26 and generally forwardly extending member 50 rigidly connect by gusset plates 52, 54 and 56 welded into an assembly. Depending upon the design of the loader, other elements may be associated with front piece 24. Forwardly extending member 50 may be formed to fit the specific tractor to which it is to be attached. For example, as best seen in FIGS. 2 and 4 a sloping step-like bend 60 is formed in member 50 to properly interface with a particular tractor structure while maintaining the vertical member 26 in proper alignment with the pivot pins on axis 34. Bolts 62 affix the front piece to a structural member of tractor 10.

A generally vertical planar surface 64 on gusset plate 56, best seen in FIG. 4, has a plurality of bolt holes 66 therethrough arranged in the same pattern as the bolt holes through surface 40. A similar pattern of bolts holes extend through gusset plate 54 such that bolts 68 extend through both gusset plates and the holes through surface 40 of rear piece 22 to draw surfaces 40, 64 together, forming a rigid connection between rear and front pieces 22, 24.

Mounting bracket 20 provides considerable flexibility and efficiency in the commercial arena. A tractor may be assembled at the factory with the relatively inexpensive rear piece 22 in position, and then shipped to a dealer for sale. If a customer decides to purchase the tractor with a loader, or later decides to add a loader, the dealer's installation efforts and costs are significantly reduced because the installation of the front piece and loader requires much less effort than the installation of the full bracket and loader. Tractors are complex assemblies of thousands of parts and components, with many on, over or adjacent the area where the rear pieced is located. With the rear piece attached during assembly of the tractor, there is no need to remove or loosen most of those parts and components during installation of the front piece and loader.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the inventions. Accordingly, the following claims are intended to protect the invention broadly as well as in the specific form shown.

What is claimed is:

1. Method for simplifying the addition of a loader to a tractor, the tractor having a structural support comprising the steps of:

providing a first two-piece loader mounting bracket for attaching a loader to a tractor, the tractor having a structural support, said bracket comprising a rear piece having a first generally vertical rigid surface with a plurality of first holes therethrough sized and located to receive an equal number of bolts to firmly affix said rear piece to said structural support of said tractor; a front piece having an elongate generally vertical member with first and second opposing ends and a generally horizontal member also with first and second opposing ends, said second ends of said vertical and horizontal members rigidly connected to each other by at least one plate forming a second generally vertical surface with holes therethrough; said generally vertical member including a surface adapted to receive, support and hold a transverse support axis of a loader, said surface located at first end of said generally vertical member; said generally horizontal member having a plurality of holes therethrough adjacent said first end thereof and located to receive an equal number of bolts to firmly affix said front piece to said tractor; and said rear piece also having a second generally vertical rigid surface with holes therethrough, said holes through said generally vertical surfaces of said at least one plate and the second generally vertical rigid surface of said rear piece; matching in alignment such that bolts extending through said holes can draw the two surfaces rigidly together by tightening nuts on said bolts;

assembling said tractor;

attaching said first rear piece of said first mounting bracket during said assembling step;

putting said tractor into the stream of commerce;

attaching said front piece of said first bracket to said tractor and said rear piece; and attaching said loader to said first two-piece mounting bracket and said tractor.

2. The method of claim 1, wherein:

said tractor has a wheel-supported main frame having right and opposing left sides, and a longitudinal axis;

providing a second two-piece mounting bracket, said second bracket being a general mirror image of said first bracket;

said assembling and attaching steps including the assembly and attachment of said second bracket, said first bracket on said left side of said tractor and said second bracket on said right side of said tractor; and aligning said front pieces of said first and second brackets such that they are generally perpendicular to said longitudinal axis of said tractor.

3. The method of claim 2, wherein:

the step of assembling said tractor further includes the step of attaching components of said tractor to said tractor and main frame adjacent to, over and adjacent to said first and second rear pieces.

4. A two-piece mounting bracket for attaching a loader to a tractor, the tractor having a structural support, said bracket comprising:

a rear piece having a first generally vertical rigid surface with a plurality of first holes therethrough sized and located to receive an equal number of bolts to firmly affix said rear piece to said structural support of said tractor;

a front piece having an elongate generally vertical member with first and second opposing ends and a generally horizontal member also with first and second opposing ends, said second ends of said vertical and horizontal members rigidly connected to each other by at least one plate forming a second generally vertical surface with holes therethrough;

said generally vertical member including a surface adapted to receive, support and hold a transverse support axis of a loader, said surface located at said first end of said generally vertical member;

said generally horizontal member having a plurality of holes therethrough adjacent said first end thereof and located to receive an equal number of bolts to firmly affix said front piece to said tractor; and said rear piece also having a second generally vertical rigid surface with holes therethrough, said holes through said generally vertical surface of said at least one plate and said second generally vertical rigid surface of said rear piece matching in alignment, such that bolts extending through said holes can draw the two surfaces rigidly together by tightening nuts on said bolts.

5. In a tractor having a longitudinal axis and structural support, the improvement comprising:

left and right rear loader bracket pieces rigidly affixed to respective opposing sides of said structural support;

said left and right rear loader bracket pieces each including:

a rear piece having a first generally vertical rigid surface with a plurality of first holes therethrough sized and located to receive an equal number of bolts to firmly affix said rear piece to said structural support of said tractor;

a front piece having an elongate generally vertical member with first and second opposing ends and a generally horizontal member also with first and second opposing ends, said second ends of said vertical and horizontal members rigidly connected to each other by at least one plate forming a second generally vertical surface with holes therethrough;

said generally vertical member including a surface adapted to receive, support and hold a transverse support axis of a loader, said surface located at said first end of said generally vertical member;

said generally horizontal member having a plurality of holes therethrough adjacent said first end thereof and located to receive an equal number of bolts to firmly affix said front piece to said tractor; and said rear piece also having a second generally vertical rigid surface with holes therethrough, said holes through said generally vertical surface of said at least one plate and the second generally rigid surface of said rear piece matching in alignment, such that bolts extending through said holes can draw the two surfaces rigidly together by tightening nuts on said bolts.

* * * * *